United States Patent [19]

Ying-Yu

[11] 4,148,102

[45] Apr. 10, 1979

[54] UMBRELLA-LIKE HAT

[75] Inventor: Chen Ying-Yu, Taichung, Taiwan

[73] Assignee: Hypromise Industrial Co., Ltd., Taiwan

[21] Appl. No.: 898,795

[22] Filed: Apr. 24, 1978

[51] Int. Cl.[2] ..... A42B 1/18; A42B 1/20

[52] U.S. Cl. ..... 2/177; 2/180; 135/5 C

[58] Field of Search ..... 135/2, 5 C, 20 R; 2/177, 180

[56] References Cited

U.S. PATENT DOCUMENTS

| | | | |
|---|---|---|---|
| 2,140,647 | 12/1938 | Myers | 135/5 C X |
| 2,227,554 | 1/1941 | Riordon | 135/5 C |
| 3,020,555 | 2/1962 | Taylor | 2/177 |
| 3,049,720 | 8/1962 | Caine | 135/5 C X |
| 3,374,488 | 3/1968 | Erbb | 2/177 |

FOREIGN PATENT DOCUMENTS

| | | | |
|---|---|---|---|
| 489092 | 1/1930 | Fed. Rep. of Germany | 135/2 |

*Primary Examiner*—Price C. Faw, Jr.
*Assistant Examiner*—Conrad L. Berman
*Attorney, Agent, or Firm*—Armstrong, Nikaido, Marmelstein & Kubovcik

[57] ABSTRACT

An umbrella-like hat for protection from sun or rain, comprising a plurality of ribs, an upper central hub, a plurality of steel threads, a lower central hub, a plurality of braces, a flexible cover, an upper tubular member, a lower tubular member, a top member, a catch member, and a plug. The hat can be readily collapsed to form a small and easily-stored package when not in use.

3 Claims, 5 Drawing Figures

UMBRELLA-LIKE HAT

BACKGROUND OF THE INVENTION

This invention relates to umbrella-like hat arranged to protect a person from sun and rain.

In the past, many devices have been evolved for protecting one from rain or sun; some of these have involved the use of an umbrella-like device mounted on the head. All of these devices have suffered from one defect or another. Most of them are difficult to manufacture and have, therefore, a high cost. None of them has been readily foldable into a small, compact package when not in use; the last disadvantage is particularly important to a golfer who requires a very compact protector which may be stored in one of the pockets of his golf bag. These and other difficulties experienced with the prior art devices have been obviated by the present invention.

SUMMARY OF THE INVENTION

The outstanding object of the present invention is to provide an umbrella-like hat which may be attached to one's head, thus leaving the hands free for activity while, at the same time, protecting one from rain or sun.

Another object of this invention is the provision of an umbrella-like hat of the type described which is inexpensive to manufacture and is capable of a long life of useful service with a minimum of maintenance.

It is another object of the present invention to provide an umbrella-like hat which is readily collapsed, when not in use, to form a small and easily-stored package.

With these and other objects in view, as will be apparent to those skilled in the art, the present invention resides in the combination of parts set forth in the specification and covered by the claims appended hereto.

DESCRIPTION OF THE PREFERRED EMBODIMENT

Figure 1:
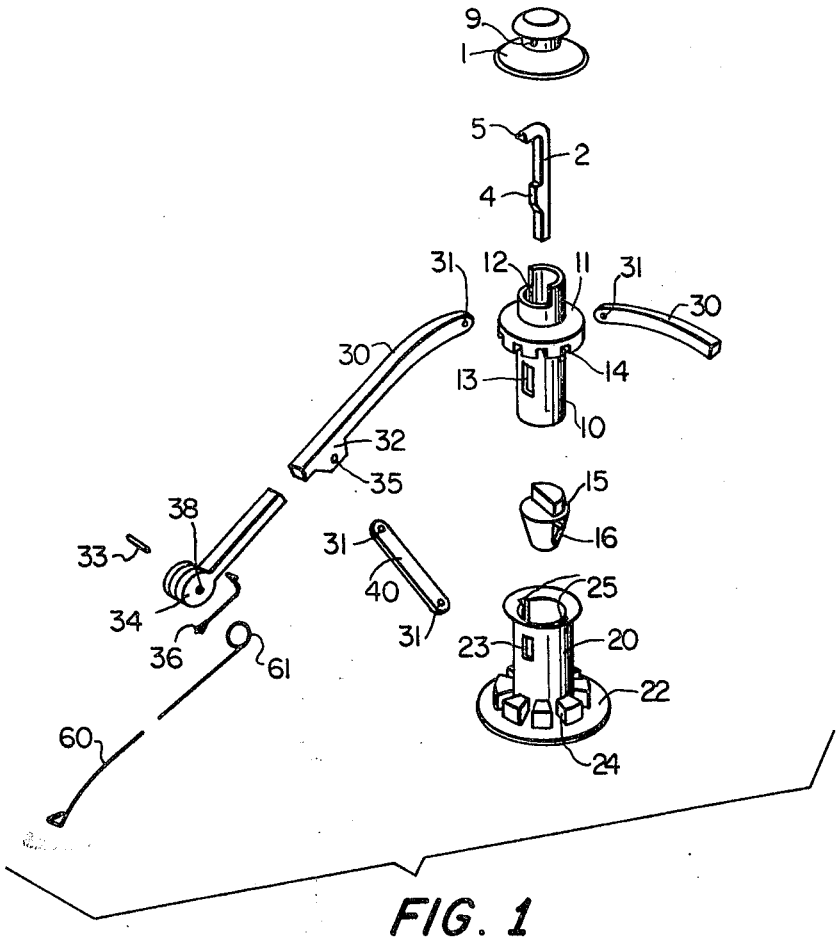
FIG. 1 is an exploded perspective view of an umbrella-like hat embodying the principles of the present invention.
Figure 2:
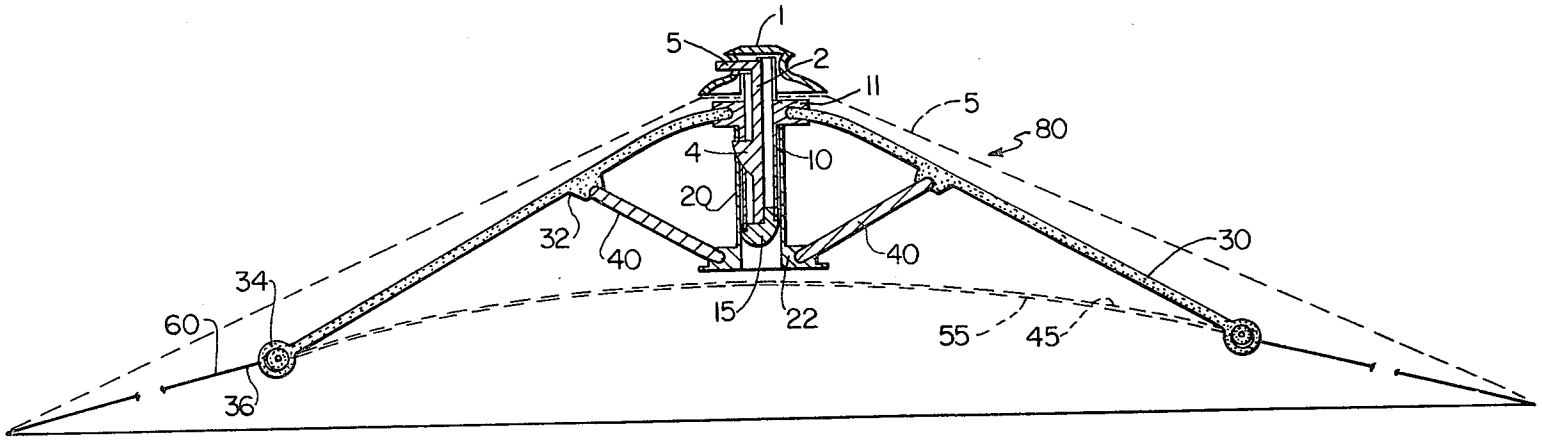
FIG. 2 is a sectional view of the invention in the opened position taken on a central line.

Referring first to FIGS. 1 and 2, wherein are best shown the general features of the invention, the umbrella-like hat, indicated generally by the reference numeral 80, as shown as having an upper central hub 11 from which radiate a plurality of ribs 30. Each rib 30 has attached thereto in a pivoting manner one end of a brace 40, the other end of which is attached to a lower central hub 22. The upper central hub 11 is formed integrally with an upper tubular member 10 with a bore disposed longitudinally therethrough. A rectangular opening 13 is provided on the periphery of the upper tubular member 10. A portion of the upper part of the upper tubular member 10 is cut away to form a cut-off portion 12. Each of the inner end of the ribs 30 is formed with a pair of small projection points 31 so that the inner end of each of the ribs 30 can be pivotally jointed on each of the slots 14 formed on the periphery of the upper central hub 11. A pair of lugs 32 having a U-shaped cross-section are located in the intermediate portion of the rib 30. Each of the braces 40 is pivoted to the lugs 32 on each of the ribs 30 respectively by means of the engagement of a pair of small projection points 31 on the outer end of each of the braces 40 and two small apertures 35 on the lugs 32. The inner end of each of the braces 40 is pivotally connected on each of the slots 24 formed on the lower central hub 22 which is formed integrally with a lower tubular member 20. The pivotal connection between the brace 40 and the lower central hub 22 is effected by the engagement of a pair of small projection points 31 on the inner end of the brace 40 and the slot 24. A bore is formed longitudinally through the lower central hub 22 and the lower tubular member 20. A rectangular opening 23 is provided on the periphery of the lower tubular member 20. The upper edge 21 of the lower tubular member 20 is expanded to facilitate the insertion of the lower edge of the upper tubular member 10 during opening operation.

A top member 1 as shown in the drawings is placed on the upper edge of the upper tubular member 10. The top member 1 has a rectangular opening 9 on its periphery. A catch means 2 having a button portion 5 on its top end and a hook portion 4 on its intermediate part is inserted into the upper tubular member 10, with the hook portion 4 projected through the rectangular aperture 13 provided on the upper tubular member 10. The button portion 5 is disposed at the cut-off portion 12 of the upper tubular member 10 and projected through the rectangular opening 9 provided on the top member 1. A plug 15 consisting of a semi-cylindrical upper part (i.e. having a semicircular cross-section) and a conical lower part is attached to the lower part of the upper tubular member 10 with the semi-cylindrical upper part thereof inserted into the lower part of the upper tubular member 10. The space 17 beside the semi-cylindrical upper part of the plug 15 is adapted to receive the lower end of the catch means 2, as is clearly shown in FIG. 2 or 4. The conical lower part of the plug 15 is provided with a pair of slantwise projections 16 located on diametrically opposite position on its surface. The inside of the lower tubular member 20 is provided with a pair of longitudinal guide recesses 25 which are adapted to engage the pair of the slantwise projections 16 of the plug 15 when the latter is inserted into the lower tubular member 20 so that the relative rotational movement between the upper tubular member 10 and the lower tubular member 20 can be prevented.

Figure 5:
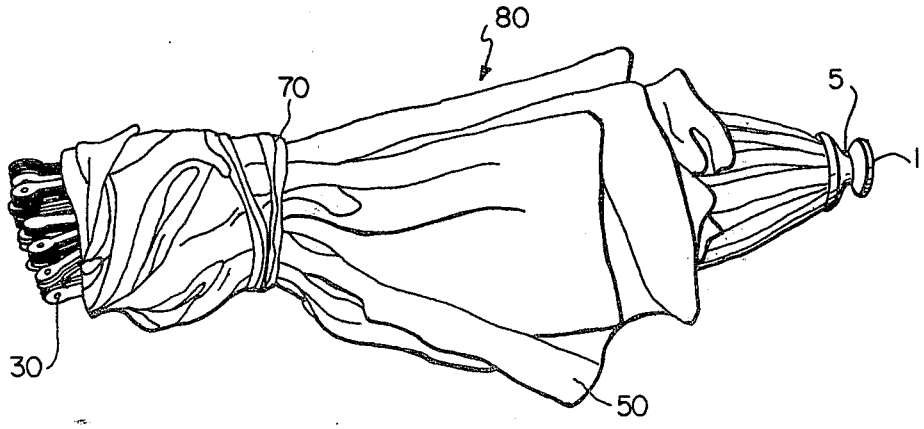
FIG. 5 is a perspective view of the invention in packed position.
Figure 3:
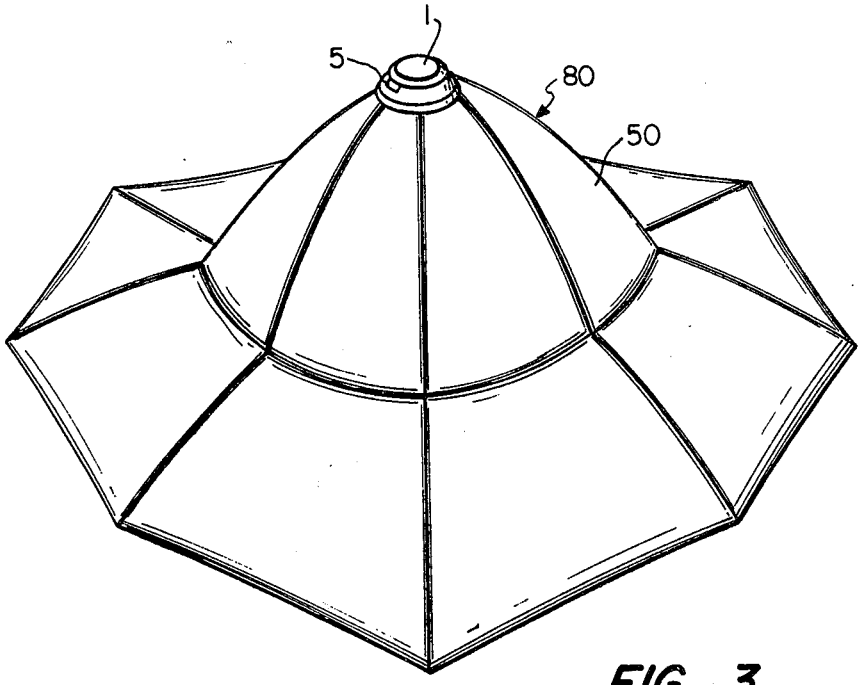
FIG. 3 is a perspective view of the invention in the opened position.
Figure 4:
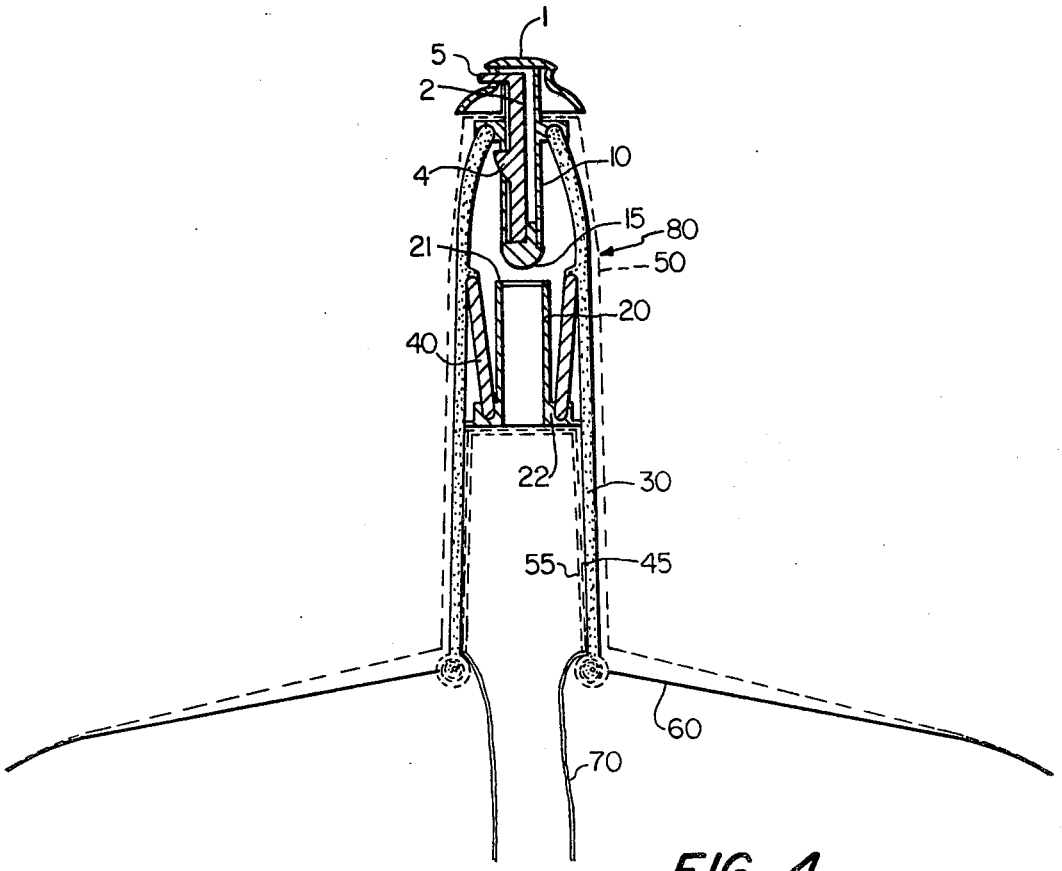
FIG. 4 is a sectional view similar to FIG. 2 in which the invention is at an intermediate position between opened and packed position.

The lower end of each of the ribs 30 take the shape of two separate circular plates 34 having a small aperture 38 on the center of each of the plates 34 and forming a gap therebetween. A steel thread 60 having a ring-shaped portion 61 on its inner end is pivotally connected to each of the ribs 30 respectively in the manner described hereinbelow. The ring-shaped portion 61 of the steel thread 60 and a spring coil 36 are inserted into the gap between the two separate circular plates 34 and a pin 33 is then inserted into the small apertures 38 on each of the circular plates 34 to hold the ring-shaped inner portion 61 and the spring coil 36 at the gap between the two separate circular plates 34. The spring coil 36 is utilized to facilitate the opening or closing of the umbrella-like hat 80. A flexible cover 50 is mounted on the ribs 30 and the steel threads 60. A string 70 for binding the ribs 30, the steel threads 60, and the flexible cover 50 together after the umbrella-like hat 80 has been closed is secured at the two ends thereof to a pair of the ribs 30 near the circular plates 34 of the ribs 30. A piece of nylon fabric (e.g. TRICOT) 45 is secured to the lower end of each of the ribs 30 under the lower central hub 22. Furthermore, a piece of thin foam sponge 55 is adhered under the piece of nylon fabric 45 for contacting with the head of a wearer of the invention and making the wearer comfortable. The operation of the invention will now be readily understood in view of the above description. FIGS. 2 and 3 show the umbrella-like hat 80 completely opened and ready for use, while FIG. 4 shows it at an intermediate position between opened and packed position. When it is desired to open the umbrella-like hat 80 shown in FIG. 5, the string 70 is untied and the ribs 30 and the steel threads 60 are moved outwardly from their collapsed positions by moving the lower central hub 22 and the lower tubular member 20 toward the upper tubular member 10. The movement of the lower central hub 22 and the lower tubular member 20 toward the upper tubular member 10 causes the braces 40 to press against the lugs 32 and against the ribs 30 to move the ribs 30 and the steel threads 60 more and more and to stretch the flexible cover 50 around the ribs 30 and the steel thread 60. When the ribs 30 have been moved outwardly the part of the upper tubular member 10 below the upper central hub 11 is inserted in the lower tubular member 20 and the hook portion 4 of the catch means 2 is projected through the rectangular opening 23 on the lower tubular member 20. The hook portion 4 is engageable with the lower tubular member 20 for locking the latter when the umbrella-like hat 80 is opened and the button portion 5 is springily retractile to release the engagement. When the umbrella-like hat 80 is in the opened position, the flexible cover 50 will act to hold the members locked together because of its inherent resilience. When the umbrella-like hat 80 is in use, the string 70 can be placed under the lower jaw of the wearer to prevent it from being blown away by wind. It will be understood that the flexible cover 50 would normally be made of cloth, and could also be made of waterproof plastic or any other flexible material. In order to collapse the umbrella-like hat 80, the button portion 5 of the catch means 2 is pushed to release the engagement between the hook portion 4 and the lower tubular member 20. In a similar manner, during the collapsing action, the lower central hub 22 and the lower tubular member 20 move downwardly until the ribs 30 are close to and generally parallel to the braces 40. The string 70 is tied around the other parts of the umbrella-like hat 80 to make the whole assembly compact. The entire umbrella-like hat 80 in collapsed position forms a small bundle whose length is determined by the lengths of the ribs 30. Naturally, since the hat is usually intended for covering the head and not for the whole body, the flexible cover 50 thereof can be considerably smaller than the conventional umbrella.

It is obvious that minor changes may be made in the form and construction of the invention without departing from the spirit thereof. It is not, however, desired to confine the invention to the exact form herein shown and described, but it is desired to include all such as properly come within the scope claimed.

I claim:

1. An umbrella-like hat for protection from sun or rain, comprising:

a plurality of ribs;

an upper central hub to which the ribs are pivotally connected;

a plurality of steel threads each pivotally connected at one end to a rib;

a lower central hub;

a plurality of braces each pivotally connected at one end to the lower central hub and at the other end to an intermediate part of a rib;

a flexible cover mounted on the ribs and the steel threads;

an upper tubular member having a rectangular opening on its periphery, the upper tubular member being formed integrally with the upper central hub with a first bore provided therethrough;

a lower tubular member having a rectangular opening on its periphery, the lower tubular member being formed integrally with the lower central hub with a second bore provided therethrough;

a top member having a rectangular opening on its periphery, the top member being provided on the upper edge of the upper tubular member;

a catch member having a button portion on its top end and a hook portion on its intermediate part, the catch member being inserted into the first bore with the button portion projected through the rectangular opening on the top member and the hook portion projected through the rectangular opening on the upper tubular member; and a plug consisting of a semi-cylindrical upper part and a conical lower part, the plug being attached to the lower part of the upper tubular member with the semi-cylindrical upper part thereof inserted into the lower part of the upper tubular member.

2. The umbrella-like hat claimed in claim 1, wherein the upper edge of the lower tubular member is expanded to facilitate the insertion of the lower edge of the upper tubular member during opening operation.

3. The umbrella-like hat claimed in claim 1 or 2, wherein a piece of nylon fabric is secured to the lower ends of the ribs, wherein a piece of thin foam sponge is adhered under the piece of nylon fabric, wherein a string is secured at two ends thereof to a pair of ribs, wherein the conical lower part of the plug being provided with a pair of slantwise projections located on diametrically opposite position on its surface, and wherein the inside of the lower tubular member being provided with a pair of longitudinal guide recess which are adapted to engage the pair of slantwise projections.

* * * * *